US005082420A

United States Patent [19]

Patrick, Jr.

[11] Patent Number: 5,082,420

[45] Date of Patent: Jan. 21, 1992

[54] METHOD FOR FORMING A BLENDED CUBE OF BRICK

[75] Inventor: Joseph H. Patrick, Jr., Greenwood, S.C.

[73] Assignee: Pearne & Lacy Machine CO., Inc., Siler City, N.C.

[21] Appl. No.: 519,797

[22] Filed: May 7, 1990

Related U.S. Application Data

[62] Division of Ser. No. 167,873, Mar. 14, 1988, Pat. No. 4,938,361.

[51] Int. Cl.[5] ..... B65G 57/28

[52] U.S. Cl. ..... 414/786; 414/789.3; 414/931

[58] Field of Search ..... 414/791.9, 789.2, 789.3, 414/931, 786; 206/595, 596, 598

[56] References Cited

U.S. PATENT DOCUMENTS

| | | | |
|---|---|---|---|
| 1,922,560 | 8/1933 | Sullivan | 206/598 X |
| 2,702,642 | 2/1955 | Bensinger | 206/596 X |
| 2,771,989 | 11/1956 | White et al. | 206/598 X |
| 2,966,260 | 12/1960 | Johnson | 206/595 X |
| 3,280,725 | 10/1966 | Bartram | 414/931 X |
| 3,392,851 | 7/1968 | Pearne et al. . | |
| 3,589,495 | 6/1971 | Pearne et al. | 198/374 |
| 3,601,266 | 8/1971 | Pearne et al. . | |
| 3,656,634 | 4/1972 | Pearne et al. . | |
| 3,695,426 | 10/1972 | Engelsberger | 206/595 X |
| 3,716,264 | 2/1973 | Pearne et al. | 294/63.2 |
| 3,893,575 | 7/1975 | Pearne et al. . | |
| 3,905,489 | 9/1975 | Berndt et al. . | |
| 3,917,080 | 11/1975 | Jones | 414/790.3 |
| 3,917,081 | 11/1975 | Pearne et al. . | |
| 3,939,993 | 2/1976 | Lingl, Jr. . | |
| 4,036,350 | 7/1977 | Jones | 414/931 X |
| 4,040,532 | 8/1977 | Pearne et al. . | |
| 4,068,766 | 1/1978 | Schmitt . | |
| 4,161,368 | 7/1979 | Batzdorff | 414/931 X |
| 4,178,122 | 12/1979 | Abrahamson | 414/789.2 X |
| 4,427,329 | 1/1984 | Milholen | 414/792.6 |
| 4,669,968 | 6/1987 | Milholen | 425/385 |

*Primary Examiner*—Robert J. Spar
*Assistant Examiner*—Janice Krizek
*Attorney, Agent, or Firm*—Pearne, Gordon, McCoy & Granger

[57] ABSTRACT

A blended cube of brick and a method and apparatus for producing same are disclosed. The cube includes vertically extending panels of columns of endwise abutting brick having a similar color and/or texture. Each layer within the cube includes one column from a panel forming the layer so that each layer contains a full blend of brick contained within the cube. The cubes are assembled with the cube resting on its side, and are subsequently turned through 90 degrees to an upright position. Therefore, the panels are assembled in a horizontal position and subsequently assume a vertical position. The method of assembling the cubes includes removing layers of brick from a stack on a kiln car and maintaining such layers in groups which are subsequently assembled in the panels. Since the brick within a given layer in a stack on a kiln car tend to have similar color and texture, this results in panels having similar color and texture. An apparatus is also disclosed for automatically performing the method.

10 Claims, 5 Drawing Sheets

METHOD FOR FORMING A BLENDED CUBE OF BRICK

This is a division of application Ser. No. 07/167,873, filed Mar. 14, 1988, now U.S. Pat. No. 4,938,361.

BACKGROUND OF THE INVENTION

This invention relates generally to the manufacture of brick, and more particularly to a strapped cube of brick containing a novel and improved blend of brick, and to a novel and improved method and apparatus for producing such cube.

PRIOR ART

Brick are generally produced by forming stacks of green brick on a kiln car which carries the brick through a tunnel kiln for firing. Such stack is arranged to provide openings in the stack through which firing gas is passed so that even the interior brick within the stack are suitably fired.

However, within a given kiln car stack, the brick in different layers are not fired in a completely uniform manner, and the color and/or the texture of the fired brick varies from one location within the stack to another location within the stack. There is a tendency for the brick in any given layer of the kiln car stack to have similar color and texture which differ from the color and/or texture of the brick in other layers.

If the brick are laid up, e.g., in a structure such as a wall, in groups which correspond to the brick contained in layers during the firing, the brick of similar color and/or texture are grouped. This provides objectionable color blotches in the wall.

A much more attractive appearance is provided if the brick are blended so that the brick in any given group of adjacent brick within the structure come from various locations in the kiln car stack. When the brick are properly blended and adjacent brick within the wall structure differ in color and/or texture from the adjacent brick, a desirable overall appearance is provided and the objectionable blotches are eliminated.

Various systems have been developed for automatically unloading fired brick from kiln cars and arranging the brick in strapped cubes for storage and shipment. Such cubes are strapped together and provide two voids permitting the cubes to be moved as a unit by fork lift equipment. Some of the systems also provide blending of the brick as they are arranged in the cube to reduce the blotch problem discussed above.

Examples of automatic unloaders and/or blenders are described in U.S. Pat. Nos. 3,601,266; 3,656,634; 3,893,575; 3,917,081; 4,040,532; and 4,068,766. All of such letters patent are assigned to the assignee of the present invention and are incorporated herein by reference.

SUMMARY OF THE INVENTION

There are a number of aspects to the present invention. In accordance with one important aspect of this invention, a typical strapped cube of brick is provided with a novel and improved blend of brick. In the illustrated embodiment, the brick in the cube are arranged so that substantially all of the brick within any given vertical cube panel originate from the same layer on the kiln car, and therefore have similar color and texture. As used herein, the term "panel" refers to vertically aligned columns of horizontally abutting and aligned brick, with each column resting upon the column below. In the illustrated embodiment, the columns contain endwise abutting brick. Since each layer of brick in the cube includes only one column of a given panel, any given layer within the cube contains a full blend of the brick within the cube. Consequently, when the mason removes a layer of brick from the cube and uses the brick in such layer to lay up a structure, the brick are fully blended. Further, as the layers are subsequently removed, each successive layer contains a full blend of the brick contained within the cube.

In the illustrated embodiment, the brick contained in each layer of the kiln car stack, which tend to have similar color and texture, are maintained in groups which are ultimately arranged in a vertical panel within the strapped cube. Therefore, the cube is inherently provided with the desired blend.

In accordance with another important aspect of this invention, a novel and improved method and apparatus are provided for positioning brick within a strapped cube to provide full blending of the brick within the cube.

In the illustrated embodiment, the brick are assembled and positioned within the cube while the cube is positioned on its side. After the cube is assembled, it is turned through 90 degrees to its normal upright position. By assembling the cube on its side, the panels of the finished cube are horizontal while the brick are being arranged in the cube, and then become vertical when the cube is turned to its upright position.

The cube is assembled so that as each panel is positioned within the cube, the panel contains brick substantially from the same layer in the kiln car stack. Consequently, the brick in each horizontal panel which ultimately form each vertical panel of an upright cube have a similar structure and texture. This results in the desired blend within the cube.

In the illustrated embodiment, the cubes are assembled in a monorail jig box apparatus. The jig boxes are provided with a width sufficient to accommodate the height of the finished cube. An automatic powered turner is provided which is operable to sequentially turn the cubes from their sides to the upright position when the cubes are completed.

Because the cubes provide voids so that the cubes can be handled by fork lift equipment, and since such voids are formed while the cube is lying on its side and are subsequently turned to an upright position, a novel and improved separator board structure is provided to support the brick adjacent to the voids while the cube is lying on its side and also while the cube is upright. In accordance with this invention, separator board structures are provided which support brick adjacent to the void along at least two sides thereof.

In accordance with still another aspect of this invention, a novel and improved unloader blender is provided which automatically removes layers of brick from a kiln car stack and subsequently delivers the layers of brick substantially intact to a plurality of inspection locations. Generally, such stacks on the kiln car are formed of faced or stacked brick in which adjacent layers within the stack are formed of two brick pairs, one resting on the other. In some instances, the brick are "face-set" in that the upper brick are inverted and positioned face-to-face on the lower brick of each pair prior to the stacking on the kiln car. In other instances, the two brick of each pair are "stacked without facing" and positioned with the faces of both brick of the pair on the upper side. The apparatus in accordance with this invention is operable to deface or destack the layers of brick after they have been removed from the kiln car so that all of the brick are face-up when they are delivered to the inspection location. In accordance with the illustrated embodiment, a multiple inspection system is provided in which the brick can be inspected at a number of locations prior to the assembly of the cubes. Therefore, the inspection can be conducted carefully and thoroughly even when the apparatus is functioning at a high production rate.

In accordance with still another aspect of this invention, a novel and improved method and apparatus are provided for turning the brick onto their sides and inserting the brick into the jig box of a monorail jig box system.

These and other aspects of this invention are illustrated in the accompanying drawings and more fully described in the following specification.

DETAILED DESCRIPTION OF THE DRAWINGS

Figure 1:
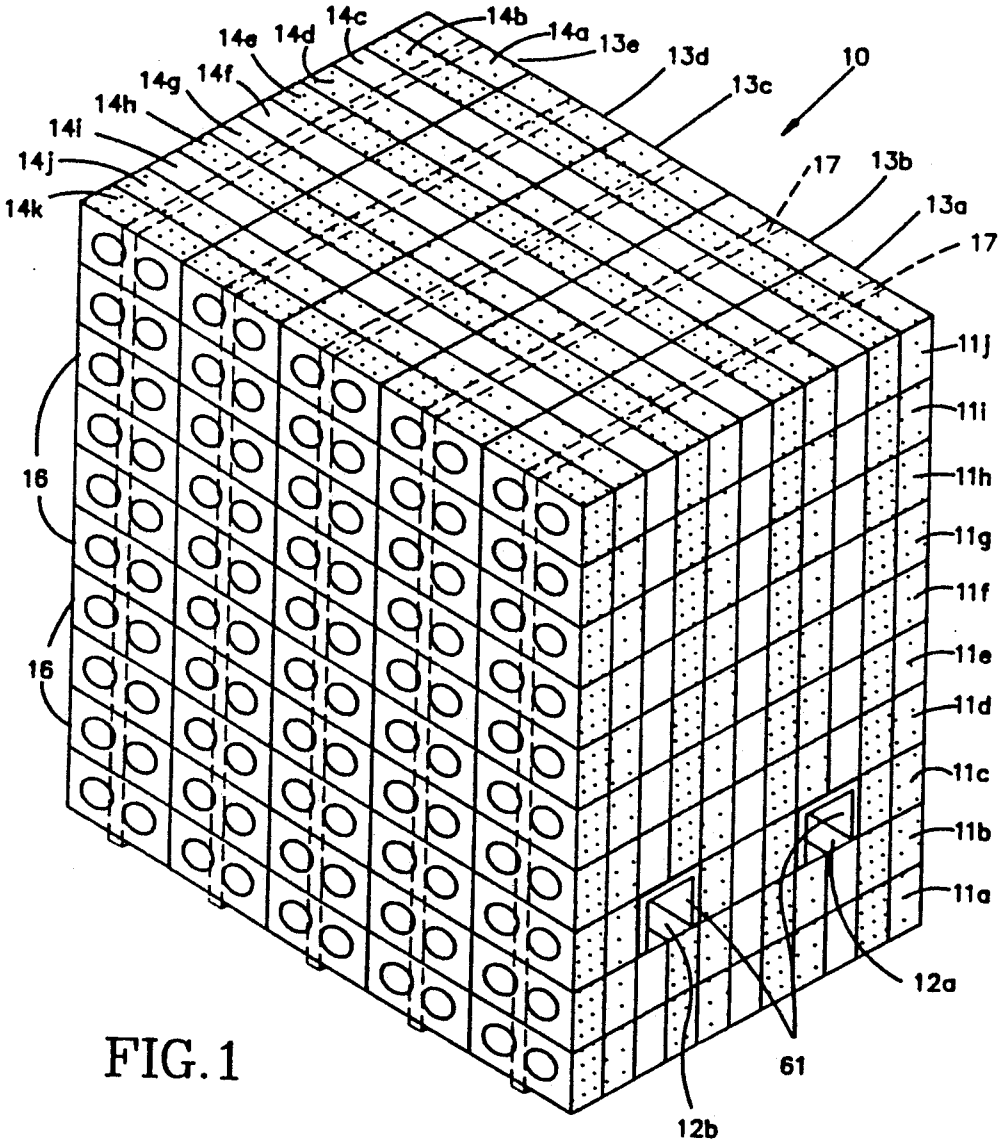
FIG. 1 is a perspective view of a strapped cube of brick in which the vertically extending panels are shaded to illustrate the blend existing within the cube.

FIG. 1 illustrates a cube of brick blended in accordance with the present invention. The cube 10 illustrated in FIG. 1 contains ten layers 11*a* through 11*j*, with the layer 11*a* constituting the bottom layer and each successive layer resting on the layer below. Two voids 12 are formed in the layer 11*c* to receive fork lift equipment for handling the cube as a unit.

These voids are formed during the assembly of the brick into the cube. In the illustrated cube 10, there are five blades 13*a* through 13*e*. There are eleven panels 14*a* through 14*k* which consist of vertically abutting columns 16 of endwise abutting brick. The columns 16 of endwise abutting brick rest one upon the next to form vertical panels 14 which extend vertically in the finished cube. Each of the panels, except those panels containing voids 12, contains ten columns 16.

Each of the blades 13 is strapped together by a strap 17, illustrated in dotted line, and pieces of cardboard (not illustrated) extend along each of the longitudinal edges of the cube to interconnect the blades 13 of the cube and to provide a unitary cube structure. Further, separator boards 61 are provided to support the brick above the voids 12.

The cube thus far described is a typical cube used in the brick industry for the storage and handling of brick, and contains 530 brick. It should be understood that in accordance with this invention, cubes of larger or smaller size containing different numbers of brick can be provided, and the particular cube 10 illustrated is only a typical example of a cube in accordance with this invention.

Figure 2:
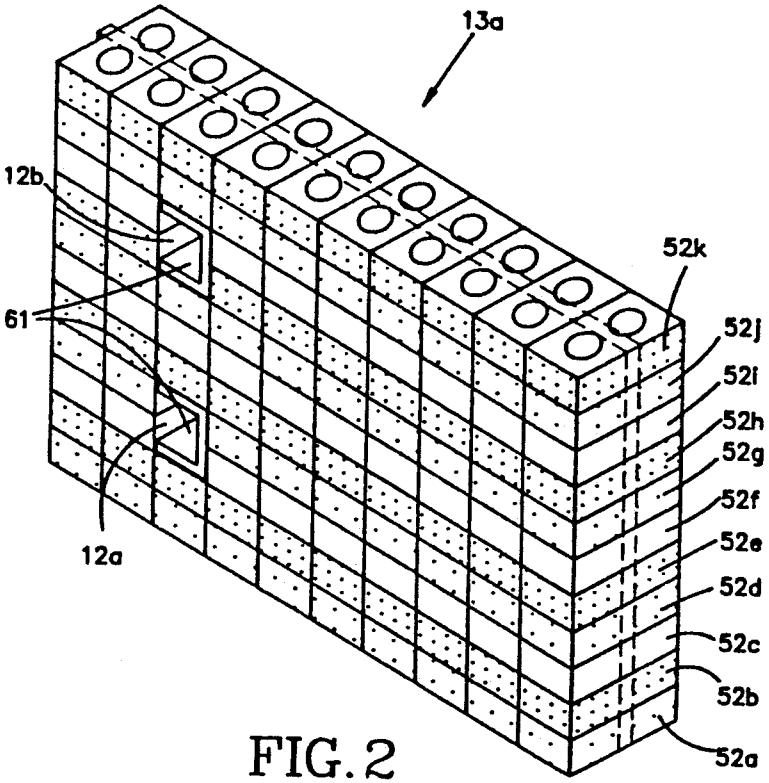
FIG. 2 is a perspective view, illustrating a blade of brick, which is subsequently strapped with other blades to form a cube, after assembly and prior to its being turned from its side to its upright position, again illustrating by shading the manner in which the brick are blended within the blade.

In FIGS. 1 and 2, the various panels are shaded to illustrate the fact that the brick in each of the panels 14*a* through 14*k* contain brick of a similar texture or color which tends to differ from the texture and/or color of the brick in the remaining panels. Therefore, each of the layers 11 contains one column of brick 16 from each panel 14 forming the layer. Therefore, each layer contains a full blend of the brick in the cube. Consequently, when the bricks are removed from the cube and laid up in a structure, a full blend is provided and objectionable color or texture blotches do not appear in the structure. Instead, the entire structure is formed of bricks which are blended to provide an attractive structural appearance.

As illustrated in FIG. 2, each blade 13 is assembled with the blade resting on its side so that horizontally aligned brick in the blade have a similar texture which differs from the brick in the adjacent layers. As discussed below, the blades are assembled in the horizontal position and strapped together to produce a cube resting on its side. After the entire cube is assembled, it is rotated through 90 degrees to the upright position illustrated in FIG. 1 to provide the blend illustrated therein.

Figure 3:
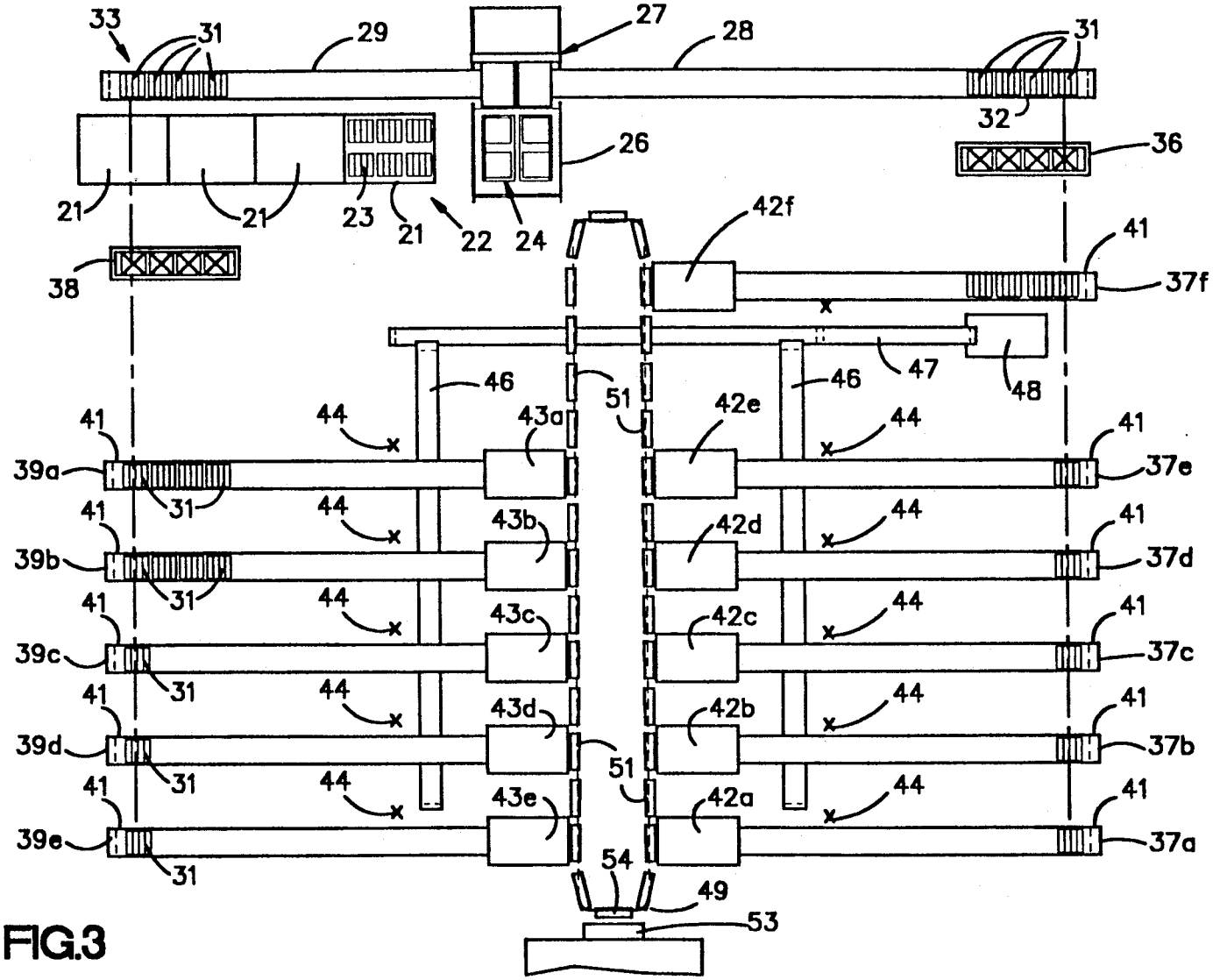
FIG. 3 is a schematic plan view of the overall system for automatically unloading fired brick from a kiln car, defacing or destacking the brick as the case may be, delivering the layers of brick to a plurality of inspection conveyors, jig box loaders for automatically arranging the brick for subsequent positioning within a monorail jig box apparatus, jig boxes, and a strapper for strapping blades of brick into cubes.

FIG. 3 schematically illustrates the overall machine for automatically unloading the kiln cars and producing a blend of bricks within a cube 10. As schematically illustrated therein, the fired brick which are stacked on kiln cars 21 are delivered to an unloading position 22. Each kiln car 21 supports a plurality of stacks of fired brick 23, and in the illustrated embodiment provides six separate stacks 23. In FIG. 3, only one of the kiln cars 21 is illustrated as supporting the stacks 23 in order to simplify the drawings. However, it should be understood that each kiln car supports a similar number of stacks which are progressively unloaded from the kiln car at the unloading position 22.

In such stacks 23, the bricks are normally arranged in double layers consisting of pairs of vertically aligned bricks resting one on the other, and in which the double layers alternately extend at right angles relative to each other.

In some instances, the double layers are face-set in that the upper brick in each double layer is inverted so that its face rests upon the face of the lower brick of the pair. In other instances, the brick are stacked without facing and both brick in each pair are in an upright position. Reference should be made to U.S. Pat. No.

3,589,495, which is incorporated herein by reference, for a detailed description of the manner in which green brick are formed and stacked on kiln cars for firing.

Located at the unloading position 22 is a powered gripper head 24 which is movable between a position over the stacks 23 on the kiln car 21 at the unloading station 22 and a position at a defacing device 26, where the brick are deposited. In this illustrated embodiment, the gripper head 24 operates to remove a double layer of fired brick from each of four stacks 23 during each cycle of operation. In the drawings, the gripper head 24 is illustrated schematically because gripper heads for unloading kiln cars are well known to those skilled in the art. However, reference may be made to U.S. Pat. Nos. 3,601,266; 3,656,634; and 3,893,575, incorporated herein by reference, supra, for a detailed description of methods and apparatus for unloading fired brick from a kiln car.

The defacer 26 operates to remove the upper brick of each pair from the lower brick of each pair and position the brick in a face-up position. In the case of faced brick, in which the upper brick are positioned on the lower brick in a face-down position, the defacer 26 rotates the upper brick of each pair through 180 degrees so that all of the brick are in a face-up condition. In the case of brick which are stacked without facing, the upper brick are removed from the lower brick of the pairs of brick without rotation through 180 degrees, and are positioned in a single high group in a face-up condition. Consequently, all of the bricks are positioned in a face-up position by the defacer 26.

Here again, the defacing unit 27 is schematically illustrated because defacers and destackers are well known to persons skilled in the art. Reference may be made to U.S. Pat. Nos. 3,601,266; 3,656,634; and 3,893,575, incorporated by reference, supra, which illustrate the structural detail and mode of operation of defacers and destackers.

Also located at 26 is a conveyor loader 27 which positions the defaced or destacked brick on the conveyors 28 and 29.

During the defacing operation, a given layer from a given stack 23 is maintained as a unit or group 31 and is supplied to one of two conveyors 28 or 29. The conveyor 28 operates to transport the groups of brick 31 from the conveyor loader 27 to a transfer position 32, and a conveyor 29 operates to move the brick groups 31 to a transfer position 33. During the unloading and defacing or destacking, each layer of brick within the stacks on the kiln car is retained as a unit or group 31 so that each of the groups of brick 31 consists of one full layer of the brick previously positioned in the stacks 23.

A first gripper transfer 36 is operable to grip four groups of brick 31 at the transfer position 32, and transfer such groups to inspection conveyors 37*a* through 37*f* to maintain a supply of brick on each of the inspection conveyors 37. Similarly, a second gripper transfer 38 is operable to grip four groups of brick 31 at the transfer position 33 and deposit such groups of brick on inspection conveyors 39*a* through 39*e*. Since there are eleven panels provided in the cube 10, eleven inspection conveyors 37 and 39 are provided.

Each of the inspection conveyors 37 and 39 operates to move the brick from its outer end at 41, where the groups of brick 31 are received, to an associated jig box loader 42*a* through 42*f* and 43*a* through 43*e*. As the groups of brick 31 are moved along the conveyors 37 and 39, they are carried past inspection locations 44, indicated by an "X" in FIG. 3. Workers at such inspection locations inspect the brick as they move along the inspection conveyors and remove brick which are broken or otherwise of inferior quality. The brick which are rejected as of unsatisfactory quality for any reason are deposited on scrap conveyors 46 which extend past each of the inspection stations to a main scrap conveyor 47 which transports the scrapped brick to a scrap location 48, where they are disposed of.

Since the brick moving along each of the inspection conveyors are face-up, they are in proper position for inspection. Further, since there are eleven inspection locations, only one/eleventh of the total production of the machine must be inspected at each inspection location. Therefore, sufficient time is available to effectively perform the inspection operations even though the overall machine may have a high production rate.

A jig box conveyor 49 in the form of a closed loop operates to progressively transport jig boxes 51 sequentially past each of the jig box loaders 42*a* through 42*f* and thereafter past each of the jig box loaders 43*a* through 43*e*. At the first jig box loader 42*a*, a full, horizontally extending row 52*a* is positioned within the adjacent jig box 51.

In the illustrated embodiment, there are ten laterally abutting brick in each row 52*a* (illustrated in FIG. 2) positioned in the associated jig box 51 by the jig box loader 42*a*. Subsequently, the conveyor 49 moves the jig box to the jig box loader 42*b* and a subsequent jig box to the jig box loader 42*a*. Because all of the brick contained within the row 52*a* have been previously located within a single layer on the kiln car 21, all of the brick contained within the row 52*a* tend to have a similar color and texture.

At the jig box loader 42*b*, a second row of laterally abutting brick 52*b* is positioned within the jig box loader, and rests on the row 52*a*. Here again, because the brick in the row 52*b* were originally located within a single layer on the kiln car, all of the brick in the row 52*b* tend to be of a similar color and texture.

It is recognized that in some instances a given row may contain brick from two different layers when the brick from one group 31 is exhausted and brick are supplied from the subsequent group 31. However, in most instances, all of the brick in a given row will be from a given group 31, and when a given row contains brick from two different groups 31, the subsequent brick supplied at such layer will be from the second group 31. Consequently, the rows 52*a* and 52*b* each tend to contain brick of similar texture and color.

While the jig box loader 42*b* is positioning in a row 52*b* on row 52*a*, the jig box loader 42*a* is loading a row 52*a* in a subsequent jig box.

Because a void 12 is provided in the next two rows, the jig box loaders 42*c* and 42*d* are operated to position only nine brick in the rows 52*c* and 52*d*. A separator board 61 is positioned within the first void formed in the blade 13*a*, as discussed in detail below, so that the brick positioned above the void 12*a* will be supported.

At subsequent jig box loaders 42*e*, 42*f*, and 43*a*, additional rows 52*e*, 52*f*, and 52*g* are positioned in the jig boxes, with one row resting on the next.

The jig box loaders 43*b* and 43*c* operate to position the rows 52*h* and 52*i* in the blade, and again function to leave one brick out to form the void 12*b*. Here again, a separator board 61 is provided, as discussed below, to support the brick above the void 12*b*.

Finally, the jig box loaders 42*d* and 42*e* position full rows 52*j* and 52*k* to complete the assembly of the blade 13*a*. Therefore, the jig box 51 leaving the jig box loader 43*e* is loaded with a full complement of brick to form one full blade 13.

When the loaded jig box 51 reaches an unloading position at 54, the blade is pushed laterally out of the jig box into a strapper 53 which applies the strap 17 and the corner connectors. In the illustrated embodiment, the strapper forms the cube by strapping together five blades 13 while the blades remain on their side in the position in which they were assembled in the jig boxes. After the cube is completed, it is turned up to an upright position by a turning mechanism illustrated in FIGS. 7 and 8. However, before discussing the turning mechanism, the operation of the jig box loaders will be described in reference to FIGS. 6*a* through 6*d*.

Figure 6A:
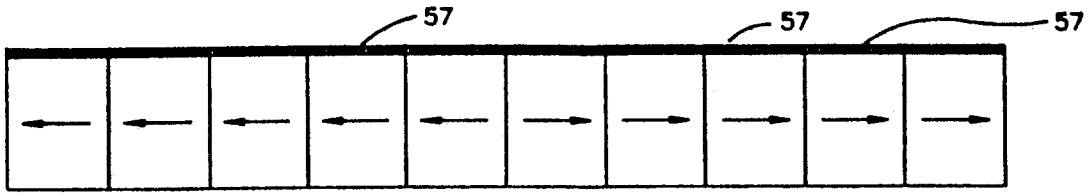
FIGS. 6*a* through 6*d* schematically illustrate the manner in which rows of brick are arranged for loading in the jig box.

The groups of brick 31 delivered to the respective jig box loaders 42 and 43 are arranged in laterally abutting rows, as best illustrated in FIG. 6*a*, and such rows contain ten brick, so as to provide one full row 52. It should be noted that the brick are resting with their faces 57 in an upward direction, which is the position the brick are delivered to the inspection conveyors for proper inspection. If the rows of brick removed from the kiln car and forming the groups of brick 31 contain a greater or a lesser number than ten brick in the illustrated embodiment, the brick are rearranged during inspection to provide rows containing ten brick across before they reach the jig box loaders 42 and 43.

Figure 6B:
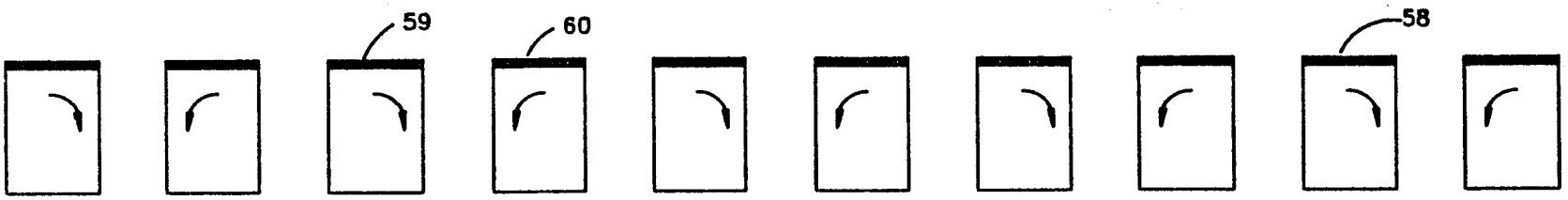
Figure 6C:
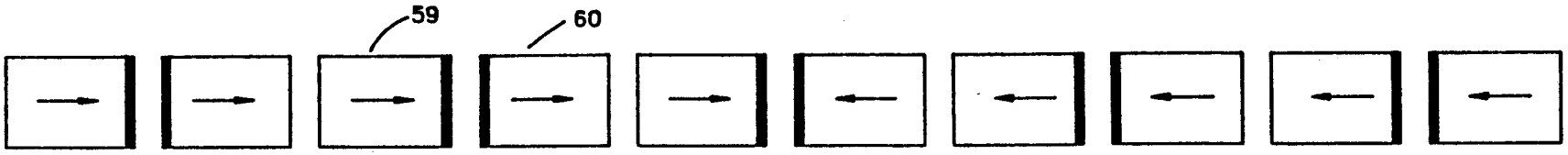

The first operation which occurs at the jig box loader is to spread the brick from the laterally abutting rows of FIG. 6*a* to rows containing laterally spaced brick, as illustrated in FIG. 6*b*. This is preferably accomplished by the use of a spreader table of the type known to those skilled in the art. For example, a spreader table of the type illustrated in U.S. Pat. No. 3,716,264, incorporated herein by reference, supra, and U.S. Pat. No. 4,669,968 (incorporated herein by reference) may be used to move the brick apart to a spaced relationship illustrated in FIG. 6*b*. After the brick have been separated, they are rotated 90 degrees to position the brick on their sides, as illustrated in FIG. 6*c*. Such turning can be performed by turners illustrated in U.S. Pat. No. 4,669,986.

Preferably, the adjacent brick are rotated in opposite directions so that the faces 57 of the brick are positioned adjacent to each other, as illustrated in FIG. 6*b*. The brick with their faces 57 engaging the face of the next adjacent brick provide the maximum protection of the faces of the brick in the finished cube.

Figure 6D:
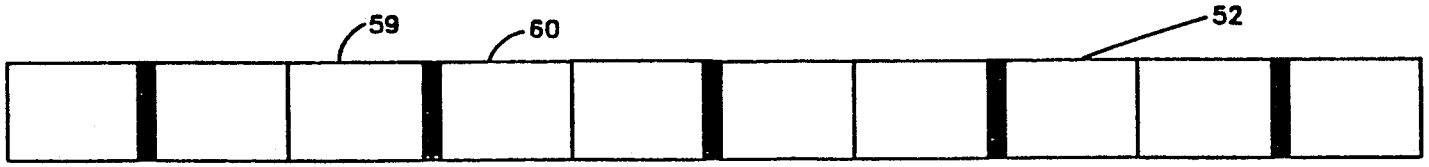

The brick are then moved laterally into abutting relationship to form the rows 52, as illustrated in FIG. 6*d*, and are subsequently moved forward as a unit into the jig box by a jig box loader of the type illustrated in U.S. Pat. No. 4,427,329. Such patent is also incorporated herein by reference.

At the jig box loaders 42*c*, 42*d*, 43*b*, and 43*c* where the said rows are formed, the brick 59 is removed, either before the manipulation occurring in the jig box loader or after the manipulations have been completed, so as to form the voids in the rows 52*c*, 52*d*, 52*h*, and 52*i*. At such loaders, the brick 60 is rotated in an opposite direction to present the back face of the brick to the exposed position within the void.

Figure 5:
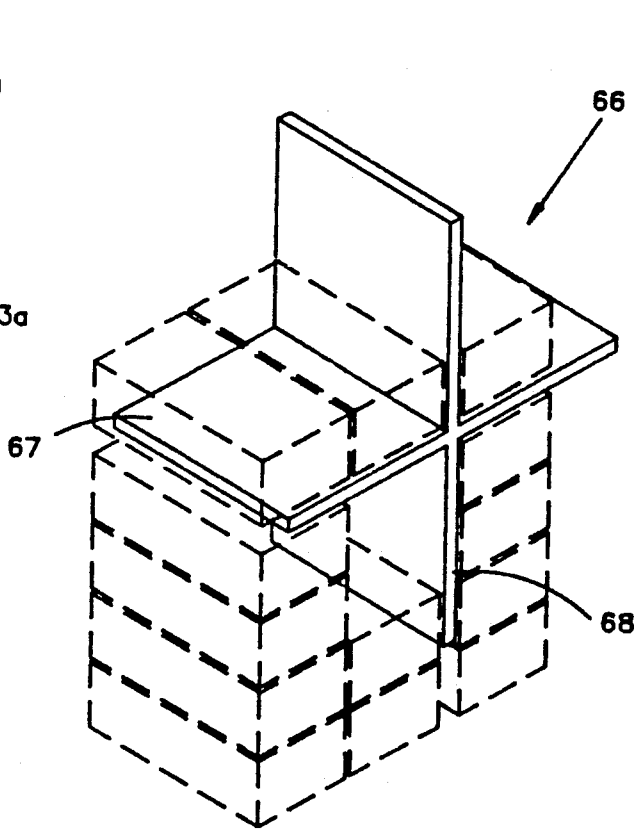
FIG. 5 schematically illustrates a third embodiment of a separator member for supporting the brick adjacent to the void.
Figure 4A:
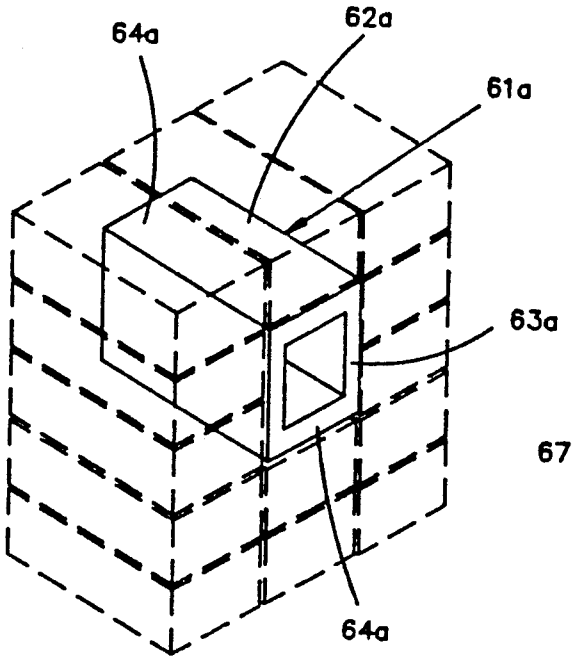
FIG. 4*a* schematically illustrates a second embodiment of a separator member for supporting the brick adjacent to the void.
Figure 4:
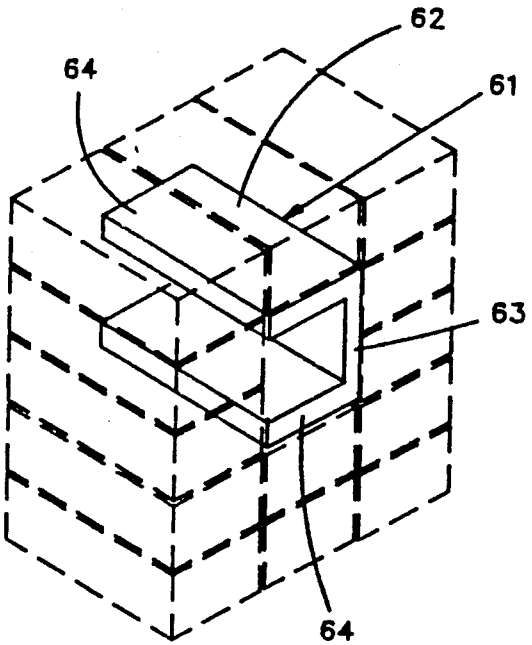
FIG. 4 schematically illustrates a first embodiment of a separator member for supporting the brick adjacent to the voids forming the cube.

Reference should now be made to FIGS. 4, 4*a*, and 5, which illustrate three different embodiments of separator boards for preventing collapse of the brick into the voids. These boards may be formed of plastic, fiberboard, wood, or cardboard. As illustrated in FIG. 4, a separator board 61 is formed with a U-shape, and is positioned within the void so that one face 62 is in the top position within the void and supports the brick above the voids while the blade is resting on its side. The adjacent face 63 is positioned within the voids so that after the cube is rotated to an upright position, such face extends horizontally and supports the brick above the void. By forming the separator board as a U-shaped element, the two legs 64 provide support for the surface 63 to support the brick above the void after the cube has been turned to an upright position.

FIG. 4*a* illustrates a tubular form of separator member 61*a*. In this embodiment, the face 62*a* is in the top position and supports the brick above the void while the blade is on its side. The face 63*a* is rotated to the upper position when the blade is turned to an upright position, and therefore supports the brick above the void in an upright blade. The two surfaces 62*a* and 64*a* support the surface 63*a* in an upright blade.

FIG. 5 illustrates another embodiment in which a separator board is structured to provide a cross structure. Such separator board 66 is positioned on top of the layer containing a void so that the board portion 67 extends across the void when the blade is resting on its side and functions to support the brick above the void, as illustrated in phantom. The portion 68 extends down along the side of the void, which will be positioned in the upper position after the cube is rotated to its upright position. Preferably, the portions of the board 67 and 68 each have a length sufficient to bridge across the void to positions between brick on each side of the void so that full support is provided for the separator board in both positions of the cube.

A similar separator board is provided in each of the void positions to support the brick above the void, first while the blade is resting on its sides, and then after it is rotated to the upright position.

Figure 8:
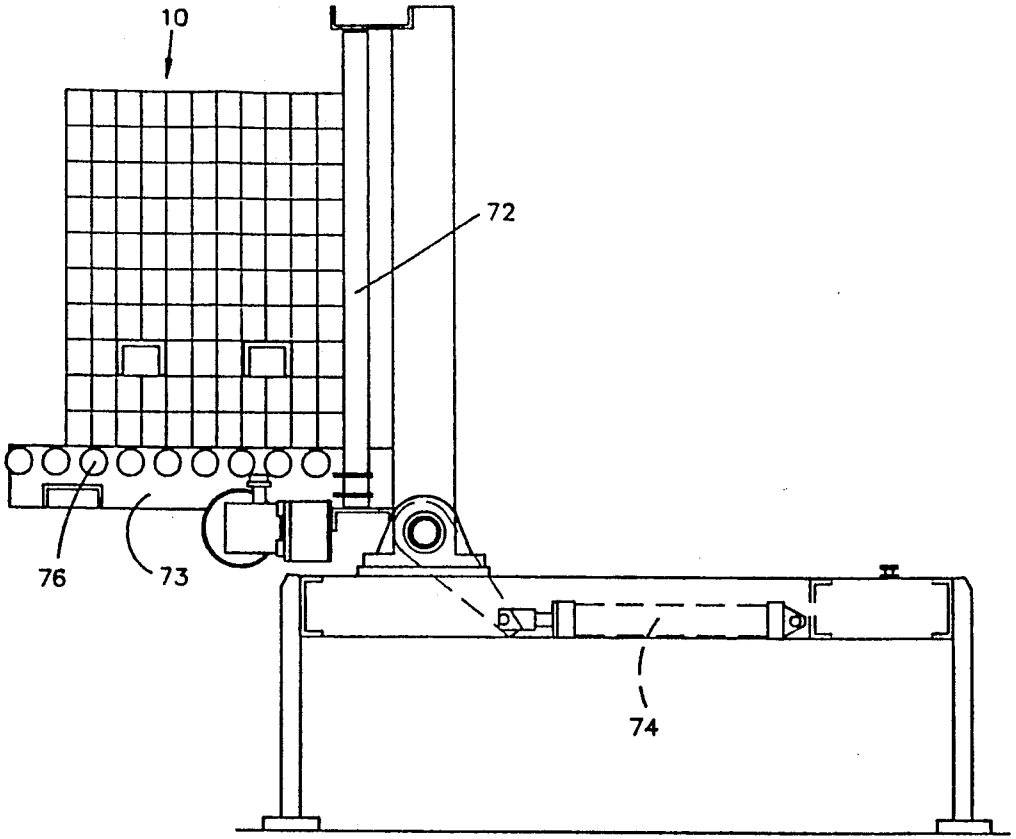
FIG. 8 illustrates the turner after the turning operation is completed.
Figure 7:
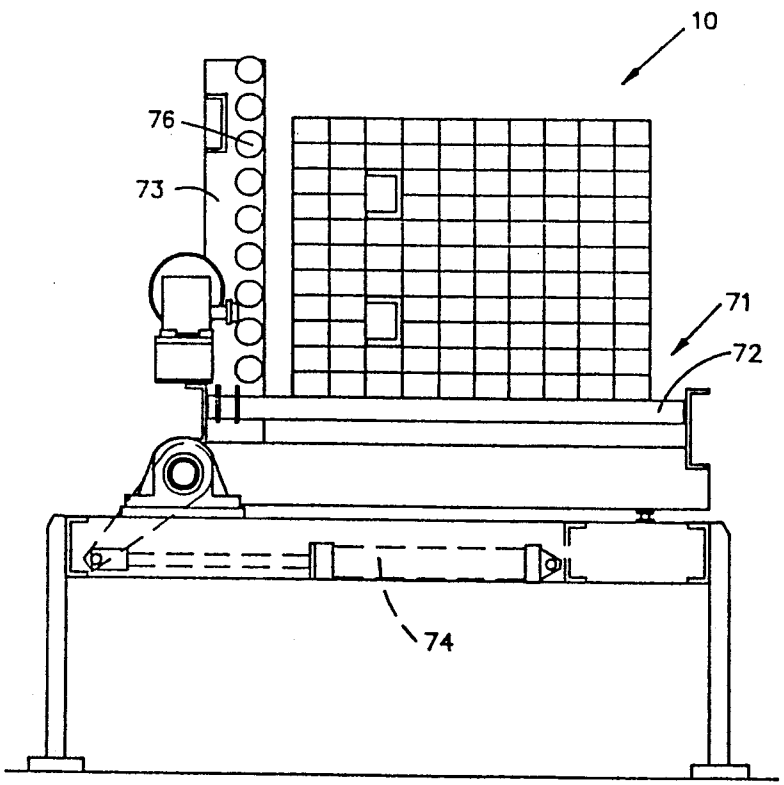
FIG. 7 is a side elevation of the turner which turns the cubes from their sides to an upright position illustrated prior to the turning operation.

Reference should now be made to FIGS. 7 and 8, which illustrate a turner 71 which operates to turn the cubes 10 after the cubes exit from the strapper. As illustrated in FIG. 7, the cube 10 is resting on its side on rollers 72 journaled on the turner frame 73. Therefore, the cube 10 is easily movable into the turner.

After the cube 10 is positioned within the turner and resting on the rollers 72, the frame 73 is rotated through 90 degrees from the position of FIG. 7 to the position of FIG. 8. Power for rotating the turner back and forth between the position of FIG. 7 and the position of FIG. 8 is provided by a piston-and-cylinder actuator 74.

As the turner is rotated through 90 degrees, with the cube 10 resting on the roller 72, the cube 10 slides laterally until the bottom face thereof engages the rollers 76 which support the cube in the upright position. In such position, the cube is then roller off the turner to the left, as viewed in FIG. 8, for storage or shipment, as the case may be.

With this simple mechanism in which the rollers 72 extend in a plane perpendicular to the rollers 76 and at right angles thereto, the cube is easily rolled into the turner from the strapper and is then easily rolled out of the turner for subsequent handling or storage. If desired, the rollers 72 and 76 can be powered by suitable actuators to actually move the cubes into and out of the turner.

With this invention, improved blending is achieved in an automated system in which full inspection can be accomplished without difficulty, even when the machine is operating at high production rates. Further, a novel and improved cube is provided in which each panel within the cube contains brick of similar texture and color, so that each layer within the cube contains a full blend of the brick within the cube. Consequently, when the brick are removed from the cube and laid up in a structure, objectionable blotches do not occur, and an attractive blended appearance is achieved.

Although the preferred embodiment of this invention has been shown and described, it should be understood that various modifications and rearrangements of the parts may be resorted to without departing from the scope of the invention as disclosed and claimed herein.

What is claimed is:

1. A method of blending brick and producing a cube of brick having a plurality of panels of vertically aligned columns of aligned and abutting brick and in which said panels each comprise a majority of brick of similar color and texture, comprising removing entire layers of fired brick from a stack in which they are fired, maintaining said layers in groups, and producing said cube with each of most of said panels respectively assembled from brick contained in a single respective stack layer.

2. A method as set forth in claim 14, including assembling said cube with the brick making up the panels initially formed in blades extending horizontally and thereafter rotating said cube through 90 degrees to an upright position in which said panels extend vertically.

3. A method as set forth in claim 2, including providing said cube with voids permitting said cube to be handled by fork lift apparatus, and positioning separator members in said voids to support brick above said voids when said panels extend horizontally and also when said panels extend vertically.

4. A method as set forth in claim 2, including transporting individual groups to a plurality of inspection positions prior to assembling said cube, and removing damaged brick from said groups at said inspection positions.

5. A method as set forth in claim 4, including positioning said brick in a face-up position at said inspection positions, and thereafter positioning said brick on their sides before assembling said cube.

6. A method as set forth in claim 5, including positioning said brick on their sides in rows of laterally abutting brick in which said faces of said brick abut the faces of adjacent brick in said rows to protect said faces from damage in said cube.

7. A method as set forth in claim 6, including assembling said rows in jig boxes to form blades of laterally abutting brick, and thereafter assembling said blades into a cube.

8. A method of blending brick and producing cubes having a predetermined number of layers, comprising removing as a unit double layers of brick from a stack of brick on a kiln car, separating said double layers into single layers with said single layers positioned with the brick therein face-up, maintaining said single layers in groups of brick, transferring said groups of brick to a plurality of inspection locations, removing damaged brick from said groups at said inspection locations, subsequently positioning said brick on their sides in rows having a number of brick equal to said predetermined number, and assembling said rows to form said cube while said cube is resting on its side, and thereafter turning said cube to an upright position.

9. A method of blending brick in cubes having a predetermined number of vertically extending panels of aligned and abutting brick, comprising removing layers of brick from a stack in which said brick are fired while maintaining each layer as an individual group, providing a plurality of loading stations, providing each loading station with one of said individual groups and producing cubes in which each one of panels is formed of brick originating at an individual loading station, assembling said cubes with the brick making up the panels initially formed in blades extending horizontally and thereafter rotating said blades through 90 degrees to an upright position in which said panels and said cubes extend vertically.

10. A method as set forth in claim 9, including forming blades of brick each having a row of brick from each of said loading stations, and assembling said blades into cubes in which one row of each blade together with a corresponding row of the other blades in the cubes form each of said panels.

* * * * *

UNITED STATES PATENT AND TRADEMARK OFFICE

CERTIFICATE OF CORRECTION

PATENT NO. : 5,082,420

DATED : January 21, 1992

INVENTOR(S) : Joseph H. Patrick, Jr.

It is certified that error appears in the above-identified patent and that said Letters Patent is hereby corrected as shown below:

Column 9, line 24, "2. A method as set forth in claim 14," should read --2. A method as set forth in claim 1,--

Signed and Sealed this

First Day of June, 1993

*Attest:*

Michael K. Kirk

MICHAEL K. KIRK

*Attesting Officer*

*Acting Commissioner of Patents and Trademarks*